US006255947B1

(12) United States Patent
Osawa et al.

(10) Patent No.: US 6,255,947 B1
(45) Date of Patent: Jul. 3, 2001

(54) THEFT DETECTING BAG

(75) Inventors: Shigeyuki Osawa, Noda; Takanori Endo, Omiya; Kouichi Ishiyama, Omiya; Masami Miyake, Omiya; Tomohiro Mori, Omiya, all of (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/233,048

(22) Filed: Jan. 19, 1999

(30) Foreign Application Priority Data

Feb. 24, 1998 (JP) ..... 10-042194
Nov. 16, 1998 (JP) ..... 10-325272

(51) Int. Cl.[7] ..... G08B 13/14

(52) U.S. Cl. ..... 340/568.7; 340/568.1; 340/570; 340/571; 340/572.1; 340/572.5; 235/7 R; 235/375

(58) Field of Search ..... 340/568.7, 571, 340/572.5, 572.8, 572.9, 568.1, 570, 572.1, 572.2, 825.35, 825.49, 825.54, 539, 572.4; 235/375, 7 R; 342/51, 42

(56) References Cited

U.S. PATENT DOCUMENTS 3,828,341 * 8/1974 Carter, Jr. et al. ..... 340/572.1
3,913,087 * 10/1975 McBrian ..... 340/572.1
4,021,807 * 5/1977 Culpepper et al. ..... 340/572.1
5,485,143 * 1/1996 Keniston ..... 340/568
5,689,238 * 11/1997 Cannon, Jr. et al. ..... 340/568
5,936,527 * 8/1999 Isaacman et al. ..... 340/572.1
6,018,298 * 12/1998 Endo et al. ..... 340/572.5

* cited by examiner

*Primary Examiner*—Edward Lefkowitz
*Assistant Examiner*—Davetta W. Goins
(74) *Attorney, Agent, or Firm*—Oblon, Spivak, McClelland, Maier & Neustadt, P.C.

(57) ABSTRACT

A tag disclosed in this invention detects theft of bills, notes, or securities positioned therewith in a cash register, a safe, or the like. The capability of a tag-detecting sensor is not affected by a conductive or magnetic auxiliary member disposed between the sensor and the tag. The tag for detecting theft, which has one or more resonant circuit sections on an insulating base sheet, is positioned with an article in a specified place. An alarm is not activated when the tag is detected by the sensor, while it is activated when the tag is not detected by the sensor. At least one of the resonant circuit sections is disposed apart from the conductive or magnetic auxiliary member, with respect to the auxiliary member to be disposed between the sensor and the tag. The specified place refers to a case positioned in a cash register or a safe; the article includes bills, notes, or securities; and the auxiliary member is a metal retainer. A fold line is formed on the insulating base sheet, and the resonator circuit sections are arranged apart from the fold line on the sheet.

14 Claims, 6 Drawing Sheets

THEFT DETECTING BAG

BACKGROUND OF THE INVENTION

1. Field of the Invention

The present invention relates to a tag having a resonant circuit section that resonates at a specified frequency of a radio wave from a radio-wave originating system. More particularly, the invention relates to a tag employed for an alarm device that gives an alarm when the tag to be located with an article is not present.

2. Description of the Related Art

Conventionally, locking a cash register or a safe in non-office hours prevents bills and the like kept therein from being stolen by someone who breaks in. In case the bills are about to be robbed by a burglar whether during business hours or non-business hours, an alarm for preventing theft is activated by an office-staff member to inform a security guard outside.

However, such a conventional type of theft preventing device requires modifications, since the staff member may not necessarily be ready to activate the alarm when a robbery occurs. Particularly, when no staff member is present, the conventional type of device does not work effectively.

SUMMARY OF THE INVENTION

Accordingly, it is a first object of the present invention to provide a tag which is used for detecting theft of articles such as bills, notes, or securities to be positioned therewith in a specified place, for example, a cash register, a safe, or the like.

It is a second object of the present invention to provide a theft detecting tag in which there is no effect on the detecting capability of a tag detecting sensor, even if a conductive or magnetic auxiliary member is arranged between the sensor and the tag.

It is a third object of the present invention to provide a theft detecting tag, which can effectively detect the theft of bills, notes, or securities.

In an aspect according to the present invention, as shown in FIGS. 1, 2, 6, and 7, there is provided a theft detecting tag including an insulating base sheet, and at least one or more resonant circuit sections disposed thereon; in which the tag allows an alarm not to be activated when it is positioned with an article in a specified place to be detected by a tag detecting sensor disposed near the article, while it allows the alarm to be activated when it is not detected by the sensor.

According to the theft detecting tag described above, the alarm is not activated when the tag is positioned with the article in a specified place. In contrast, the alarm is activated to inform the incident of a theft when the tag is taken out with the article and the absence of the tag in the specified place is detected by the sensor.

Here, when a conductive or magnetic auxiliary member is arranged between the tag detecting sensor and the tag, at least one of the resonant circuit sections may be disposed apart from the auxiliary member.

Therefore, in this case, even if the conductive or magnetic auxiliary member is disposed between the tag detecting sensor and the tag, the auxiliary member does not change a self-inductance of the resonant circuit section, so that the sensor can detect the presence of the tag. When the tag is taken out of the specified place with the article, the tag detecting sensor detects the absence of the tag in the specified place so as to allow the alarm to be activated.

Regarding the tag, preferably, the specified place is a case in a cash register or a safe; the article is a number of bills, notes, or securities; the auxiliary member is a metal retainer of the article; and the insulating base sheet is a theft detecting tag formed into substantially the same shape and size as those of the article.

This tag allows detection of the theft of bills, notes, or securities kept in the cash register or safe which have the metal retainer; and the insulating base sheet formed into substantially the same shape and size as those of the article is kept with the article so as to effectively allow detection of the theft.

Furthermore, in the theft detecting tag, as shown in FIGS. 6 and 7, when fold lines corresponding to fold lines or perforations of the article are formed on the insulating base sheet, the resonant circuit sections may be disposed apart from the fold lines of the base sheet.

Thus, in this case, even if the tag is mistakenly folded with bills, etc., together, the resonant circuit sections are not damaged.

According to another aspect of the present invention, as shown in FIGS. 11 to 13, there is provided a theft detecting tag including a main part of the tag which is composed of the insulating base sheet and one or more resonant circuit sections disposed thereon, being positioned in a case of a cash register or safe having a tag detecting sensor and keeping the bills, notes, or securities, in which the main part of the tag allows the alarm not to be activated when it is detected by the sensor, while it allows the alarm to be activated when it is not detected by the sensor; and an attached sheet which is partially adhered to the main part of the tag by stacking one or more sheets on one side or both sides of the main part of the tag, and which has the same shape, size, and texture as those of the bills, notes, or securities.

In this tag, when a person (hereinafter referred to as a robber) seizes the bills or the like stacked on an attached sheet, taking them without permission, the robber feels that the attached sheet has the same texture as the bills, etc. As a result, the attached sheet is taken out with the bills, etc., by the robber without precaution. Additionally, the main part of the tag is taken out with the attached sheet, since the attached sheet is partially adhered to the main part of the tag. Thus, this allows the tag detecting sensor to detect the absence of the main part of the tag in the specified place and allows the alarm to be activated to inform the incident of the theft.

Regarding the tag, when a conductive or a magnetic auxiliary member is disposed between the tag detecting sensor and the main part of the tag, at least one of the resonant circuit sections may be disposed apart from the auxiliary member, and no resonant circuit sections may be disposed at a position retained by the auxiliary member.

Here, when the main part of the tag is disposed in the case, of the resonant circuit sections, the resonant circuit section disposed apart from the auxiliary member produces resonance, so that a tag detecting circuit does not activate the alarm.

It is possible for the tag to be folded at the position where there is no resonant circuit section, and it is impossible for the resonant circuit section to be damaged even if the auxiliary member is repeatedly placed to retain the main part of the tag, since there is no resonant circuit section at the position retained by the auxiliary member.

In other words, concerning a tag arranged in such a manner that a resonant circuit is present at the position retained by the auxiliary member, when the tag damaged due to being folded or repeated retaining by the auxiliary member is arranged in the reversed direction, the alarm can mistakenly be activated. However, the tag of the present invention does not permit such a fault to occur.

Regarding the tag in this case, when the conductive or magnetic auxiliary member is disposed between the tag detecting sensor and the main part of the tag, at least one of the resonant circuit sections may be disposed apart from the auxiliary member, and, a metal sheet of the same thickness as that of a conductive metal foil forming the resonant circuit section at the position retained by the auxiliary member may be disposed on the insulating base sheet.

Here, when the main part of the tag is arranged in the case, of the resonant circuit sections, the resonant circuit section disposed apart from the auxiliary member produces resonance, so that the tag detecting circuit allows the alarm not to be activated.

Since this tag has the metal sheet arranged as above, the strength of the tag can be increased and the thickness of the tag can be uniform, so that the bills or the like to be stacked on the attached sheet can be kept in a natural manner.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
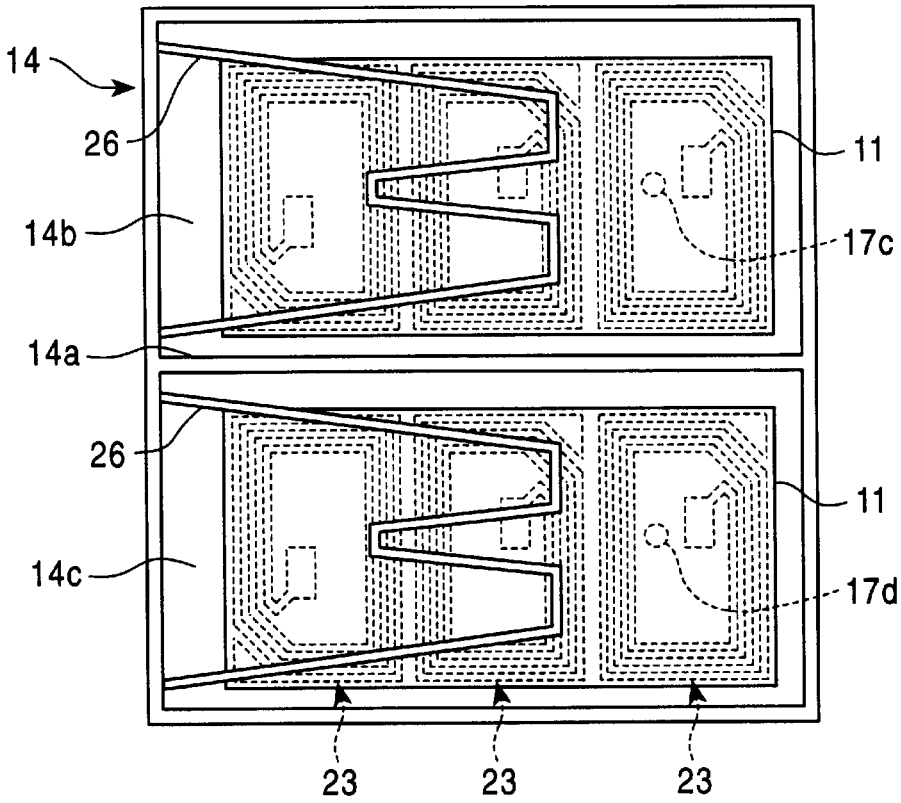
FIG. 1 is a top view of a theft detection tag according to a first embodiment of the present invention, in which the tag is positioned in a specified place.

Referring now to the drawings, a description will be given of a first embodiment according to the present invention.

Figure 2:
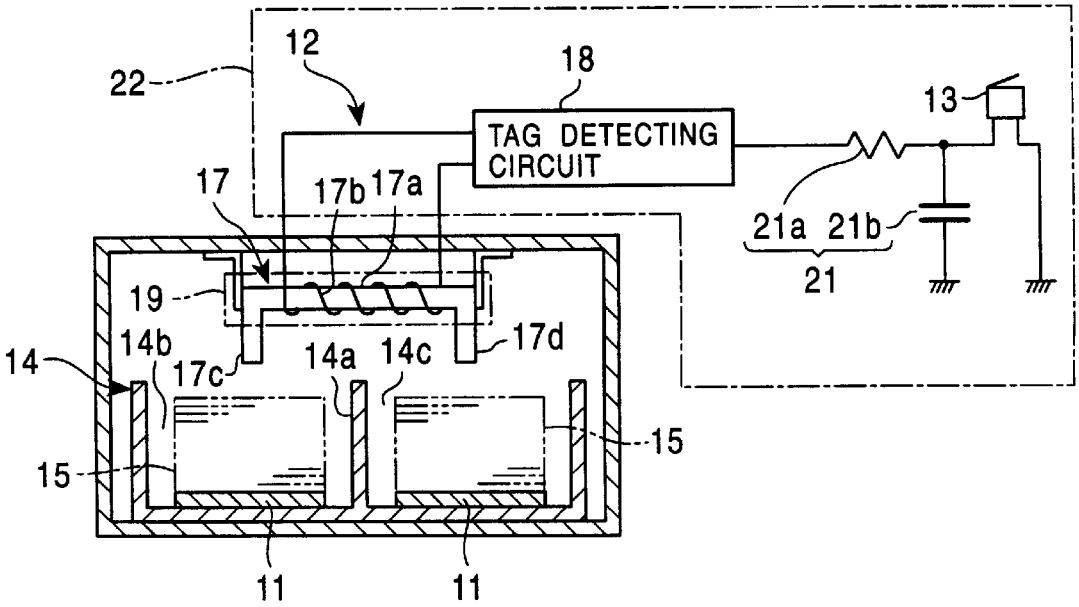
FIG. 2 is a block diagram showing a relationship between a tag detecting sensor and an alarm.

As shown in FIG. 2, a theft detecting tag 11 according to the present invention is employed for a radio-wave theft detecting device, which allows an alarm 13 not to be activated when the tag 11 is detected by a tag detecting sensor 12, and which allows the alarm 13 to be activated when the tag 11 is not detected by the sensor 12. The radio-wave theft detecting device of the embodiment above is disposed in a safe 16 containing a drawer 14, which is a case. Although not shown in FIG. 1, an opening for taking out the drawer 14 is formed on the front of the safe 16. The opening is arranged in a manner that it can be opened and closed by a front door. The article 15, which is supposed to be prevented from a theft, denotes a number of bills kept in the safe 16.

The tag detecting sensor 12 has an antenna 17 disposed on the inner surface of the upper side of the safe 16 and a tag detecting circuit 18 electrically connected to a coil 17*b* of the antenna 17. The antenna 17 has a core 17*a* formed of ferrite extending in the width-direction of the safe 16, a coil 17*b* wound on the core 17*a*, and a pair of arms 17*c* and 17*d* formed of ferrite, which are respectively disposed at both ends of the core 17*a* in such a manner that they protrude in the direction of the two tags 11. The core 17*a* having the coil 17*b* and each base-end of the pair of arms 17*c* and 17*d* are covered by an electromagnetic wave absorber 19 and an electromagnetic interference sealed material (not shown) through an insulating material (not shown) such as a plastic tape, etc. As shown by dashed lines in FIG. 1, the top ends of the arms 17*c* and 17*d* are disposed apart from metal retainers 26, which will be described below.

Figure 3:
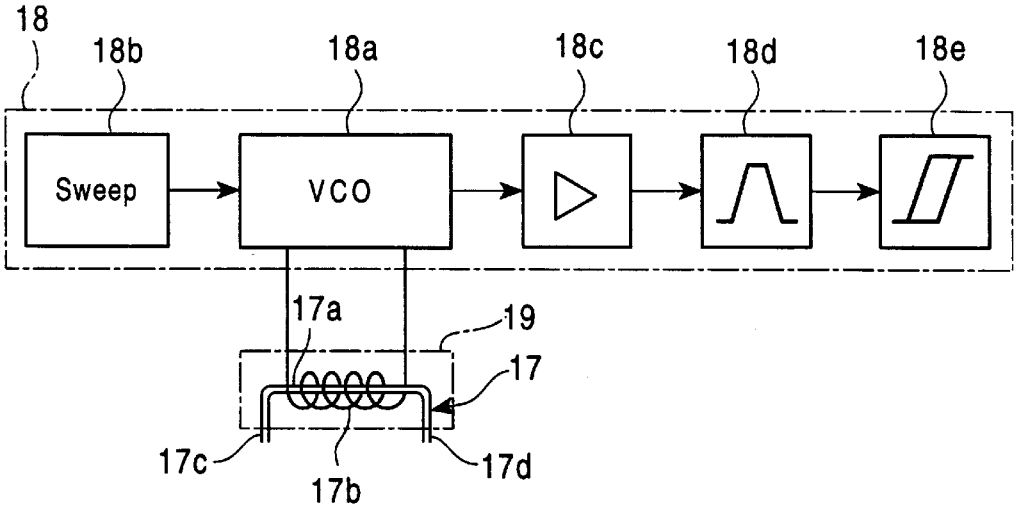
FIG. 3 is a block diagram of a tag detecting circuit.

As shown in FIG. 3, the tag detecting circuit 18 has a voltage-controlled oscillator 18*a* which is electrically connected to the coil 17*b* of the antenna 17 so as to feed current with the same frequency as the resonant frequency of the tag 11 to the coil 17*b*, a sweeping unit 18*b* for sweeping the transmission frequency of the oscillator 18*a* in the range of 7~9 MHz, an amplifier 18*c*, the input of which is connected to the output of an automatic gain controller of the voltage-controlled oscillator 18*a*, a noise filter 18*d*, the input of which is connected to the output of the amplifier 18*c*, and a threshold element 18*e*, the input of which is connected to the output of the noise filter 18*d*. The tag detecting circuit 18 is arranged in such a manner that a specified signal emerges in the output of the automatic gain controller of the voltage-controlled oscillator 18*a*, when the below-mentioned resonant circuit section 23 produces resonance by approaching of the tag 11 to the coil 17*b*. In this arrangement, the specified signal is amplified by the amplifier 18*c*; after a mixing noise signal is eliminated by the noise filter 18*d*, a selection on the signal is performed by the threshold element 18*e*. When the waveform selected by the threshold element 18*e* does not include the waveform of the above specified signal, an ON-signal "1" is output from the threshold element 18*e*, while when the waveform selected by the threshold element 18*e* includes the waveform of the above specified signal, an OFF-signal "0" is output from the threshold element 18*e*.

Referring back to FIG. 2, the control output of the tag detecting circuit 18 is connected to a buzzer 13 as an alarm. Between the tag detecting circuit 18 and the buzzer 13 is connected a time constant circuit 21 which is composed of a resistor 21*a* and a capacitor 21*b*, so that the time constant circuit 21 prevents the buzzer 13 from being mistakenly activated, when a chattering occurs in the output of the threshold element 18*e*. The tag detecting circuit 18, the buzzer 13, and the time constant circuit 21 are contained in a case 22 which is disposed on an external surface of the side wall of the safe 16.

Figure 4:
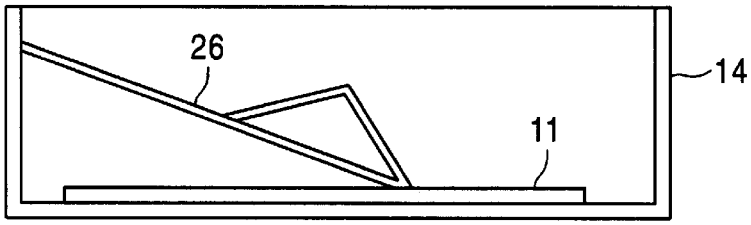
FIG. 4 is a cross-sectional view showing a state in which the auxiliary member is arranged in a manner of retaining the tag.
Figure 5:
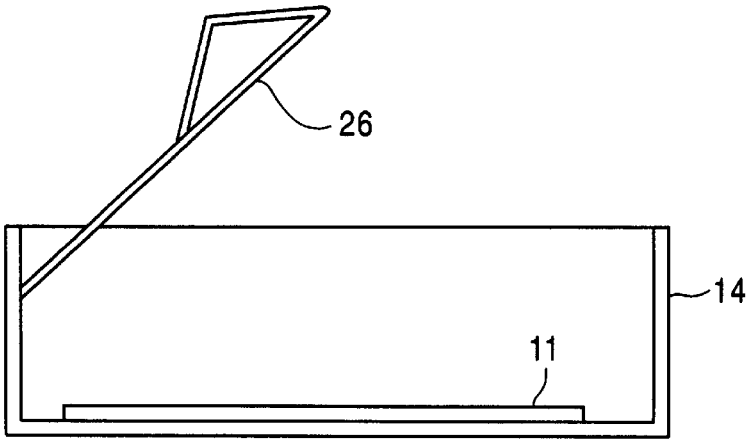
FIG. 5 is a cross-sectional view of a case in which an auxiliary member retaining the tag is lifted up, corresponding to FIG. 4.

As shown in FIGS. 1 and 2, the drawer 14 in the safe 16 is formed of a non-magnetic material such as plastic, etc., and is partitioned into a pair of bill-containers 14*b* and 14*c* to be divided respectively on right and left by a partition plate 14*a* extending in the direction for pulling out the drawer. In the pair of bill-containers 14*b* and 14*c* are respectively disposed the metal retainers 26 for retaining contained bills from the top (FIG. 1). The metal retainers 26 employed in this embodiment are made of steel wires bent substantially in the form of the letter of M; and the base ends of the retainers are respectively pivoted on the drawer 14 through a coil spring, which is not shown. The energizing force of the coil spring permits the metal retainer 26, as shown in FIG. 4, to retain the bills 15 from the top in such a manner that the top end of the metal member abuts the top surface of the bills 15. At the same time, as shown in FIG. 5, a stronger force than the energizing force of the coil spring permits the auxiliary metal member 26 to be lifted up, so that the retained bills can be taken out. In FIG. 2, the tags 11 are respectively placed at the bottoms of the bills 15 which are contained in a stacked manner in the pair of bill-containers 14*b* and 14*c*. As shown in FIG. 1, the metal retainers are arranged in a manner that they retain the bills 15 by placing the tags at the bottoms of the bills.

Figure 6:
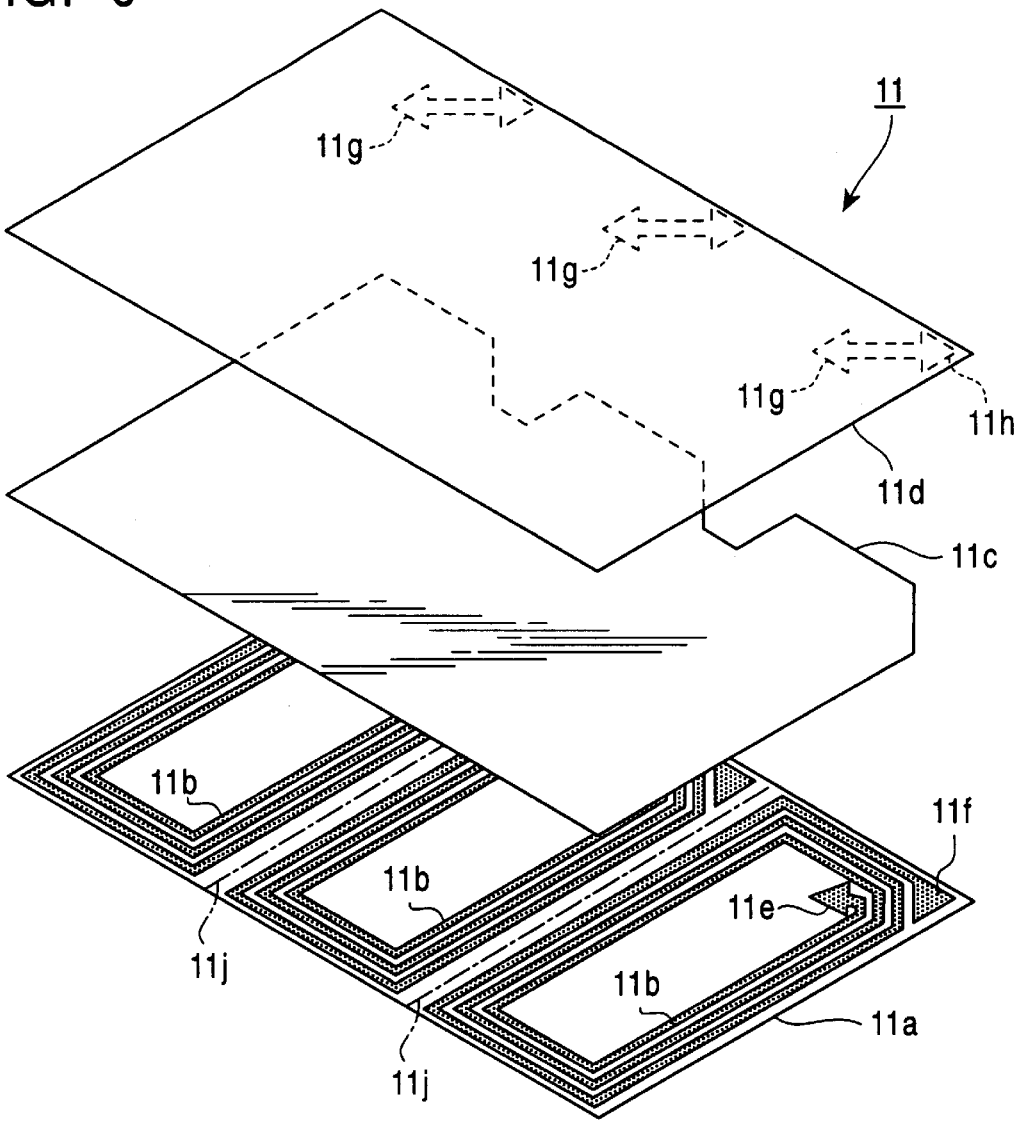
FIG. 6 is an exploded perspective view of the theft preventing tag.
Figure 7:
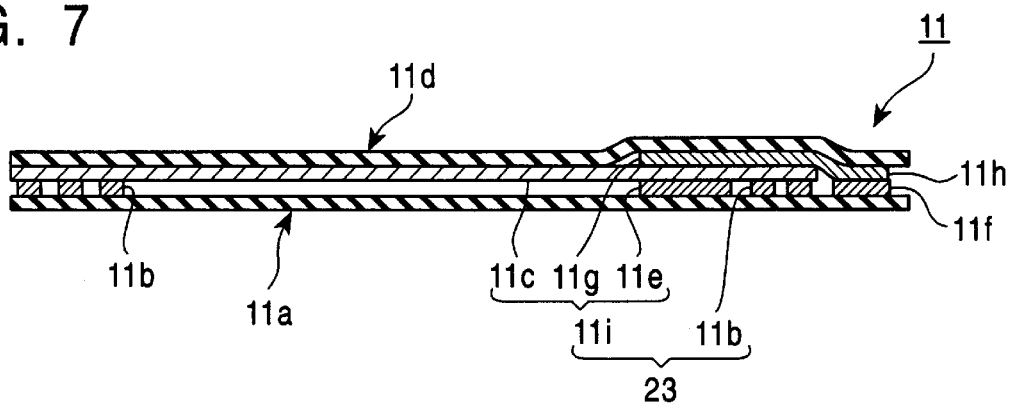
FIG. 7 is a vertical-sectional view of the tag.

The tag 11 is made of the same shape and size as those of the bill 15. As shown in FIGS. 6 and 7, the tag 11 has the insulating base sheet 11*a* formed of an insulating material, such as a paper, a plastic thin plate, etc., a coil 11*b* formed in a spiral form of a substantially rectangular shape by conductive materials such as copper, aluminum, etc., on the insulating base sheet 11*a*, a dielectric layer 11*c* formed of an insulating material and adhered to the insulating base sheet 11*a* in a manner that the layer covers the upper surface of the base sheet 11*a* through the coil 11*b*, and a surface layer 11*d* formed of an insulating material and adhered to the dielectric layer 11*c* in a manner that the layer 11*d* covers the upper surface of the layer 11*c*.

The three coils 11*b* with the substantially same shape and size are formed at specified intervals on the insulating base sheet 11*a* of the embodiment. These intervals are generally formed at positions corresponding to the fold lines made when the bills 15 are folded. Numeral 11*j* denotes a fold line given with the assumption that the bills 15 and tag 11 are folded together. In other words, in the embodiment, the three coils 11*b* are formed apart from the fold lines 11*j* on the surface of the insulating base sheet 11*a*. Each coil 11*b* is adhered to a first electrode layer 11*e* and a first connecting terminal 11*f*, which are formed of a conductive material and electrically connected to the inner end and outer end of the coil 11*b*, respectively. Meanwhile, the dielectric layer 11*c* is adhered to the surface of the insulating base sheet 11*a* in such a manner that the layer 11*c* covers the parts excluding the first connecting terminal 11*f* thereon. The coil 11*b*, the first electrode layer 11*e*, and the first connecting terminal 11*f* are formed by etching a conductive metal foil (not shown) formed in close contact with the upper surface of the insulating base sheet 11*a* with a specified pattern.

To the lower surface of the surface layer 11*d* are respectively adhered a second electrode layer 11*g* and a second connecting terminal 11*h* which are formed of a conductive material and opposing the first electrode layer 11*e* and the first connecting terminal 11*f*; and the second electrode layer 11*g* is electrically connected to the second connecting terminal 11*h*. The first and second connecting terminals 11*f* and 11*h* are electrically connected to each other, when the surface layer lid is stacked through the dielectric layer 11*c* on the insulating base sheet 11*a*. The first electrode layer 11*e*, the dielectric layer 11*c*, and the second electrode layer 11*g* form a capacitor 11*i*. The capacitor 11*i* and the coil 11*b* form three resonant circuit sections 23. The resonant frequency of the resonant circuit sections 23 of the embodiment is 7~9 MHz. As shown in FIG. 1, when the tags 11 are placed on the bills contained in the bill-containers 14*b* and 14*c* to retain the bills by the metal retainers 26 through the tags 11, one of the resonant circuit sections 23 is disposed apart from the metal retainer 26, which is an auxiliary member.

In the theft detecting tag having such an arrangement, since the tag opposes the antenna 17, the tag detecting sensor 12 detects the two tags 11, and the threshold element 18*e* outputs "0" so as allow the buzzer 13 not to be activated. In this state, the metal retainer 26, which is a conductive auxiliary member, is disposed between the tag detecting sensor 12 and the tag 11. However, since one of the three resonant circuit sections 23 of the tag 11 is disposed apart from the metal retainer 26, the tag 11 approaches to the coil 17*b* to allow the resonant circuit section 23 to produce resonance, while the tag detecting circuit 18 does not activate the buzzer 13.

Even if one of the two tags 11 is taken out with the bills 15 from the drawer, the tag detecting sensor 12 continues to detect the other tag 11 left in the drawer 14. Thus, the threshold element 18*e* continues to output "0" so as not allow the buzzer 13 to be activated. This arrangement is given considering that there is a case where the owner of the safe 16 counts the number of the bills kept in the safe. Even if the tag is folded with the bills 15 and the fold line 11 is made on the tag, since the coil 11*b* is not formed at the fold line, neither breaking of the coil nor damage of the resonant circuit section 23 occurs.

On the other hand, when both the tags 11 are taken out with the bills from the drawer 14, the tag detecting sensor 12 detects the absence of the tags 11 in the drawer 14 and the threshold element 18*e* outputs "1". This permits the buzzer 13 to be activated, so that an alarm given by the buzzer 13 allows the owner of the safe 16 to be immediately informed of the removal of the bills 15 kept in the safe without permission, leading to quick reporting by the owner to the police.

Figure 8:
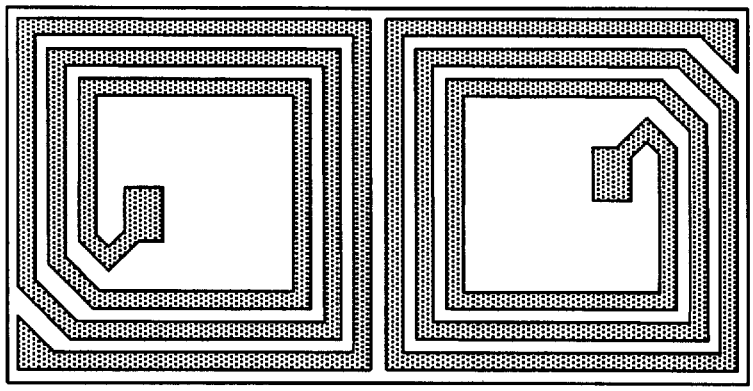
FIG. 8 is a plan view of a theft preventing tag having two resonant circuit sections.
Figure 9:
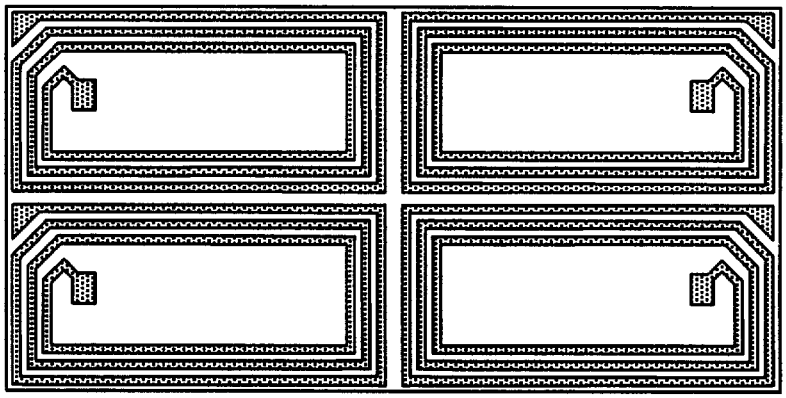
FIG. 9 is a plan view of a theft preventing tag having four resonant circuit sections.
Figure 10:
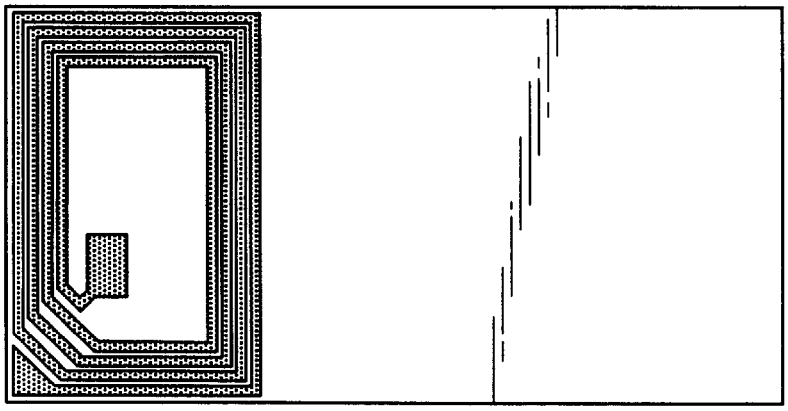
FIG. 10 is a plan view of a theft preventing tag having a single resonant circuit section formed on an edge side of the base sheet.

In the first embodiment above, the three resonant circuit sections are formed on the insulating base sheet in such a manner that the resonant circuit sections are not disposed at positions corresponding to the fold lines of the bills. When the bills are folded into two, two resonant circuit sections are formed, as shown in FIG. 8, while when the bills are folded into four, four resonant circuit sections are formed, as shown in FIG. 9. In this state, it is possible for the resonant circuit sections not to be damaged. In addition, as shown in FIG. 10, a single resonant circuit section may be formed at an edge side on the insulating base sheet, as long as it is disposed apart from the conductive or magnetic auxiliary member.

Furthermore, in the first embodiment above, the tag is placed at the bottom of the stacked bills. However, without being restricted to the bills, securities such as stock certificates, etc., or notes such as postal stamps, etc., are also contained together with the tag. The position for placing the tag is not restricted to the bottom of the article. Other positions, for example, a medium position between or the top of the bills, are also possible.

Additionally, the tag can be taken out together with the bills by bundling both of them to be placed in a box, an envelop, or the like. In this case, when the bills are taken out from the drawer, the tag is supposed to be taken out together with the bills. Accordingly, if the bills, etc., are taken out without permission, a detection of the incident can be performed more effectively.

The values of the resonant frequency given in the first embodiment above are shown as an example, and values of the resonant frequency should not be restricted to this range.

Figure 11:
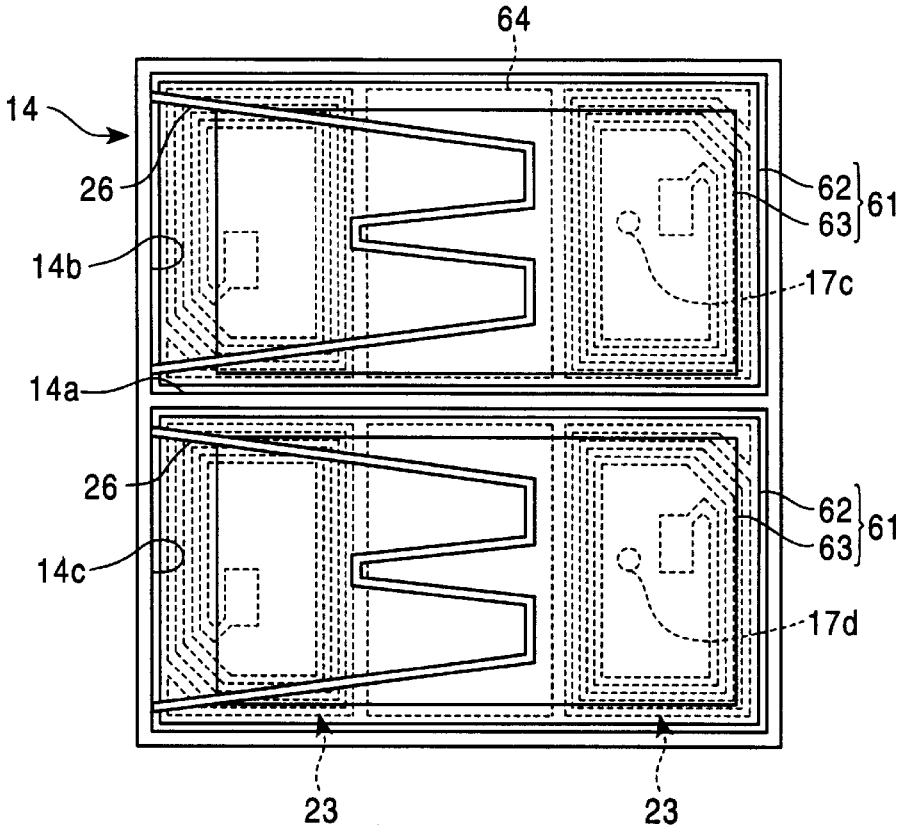
FIG. 11 is a top view of a theft preventing tag according to a second embodiment of the present invention, in which the tag is positioned in a specified place.
Figure 12:
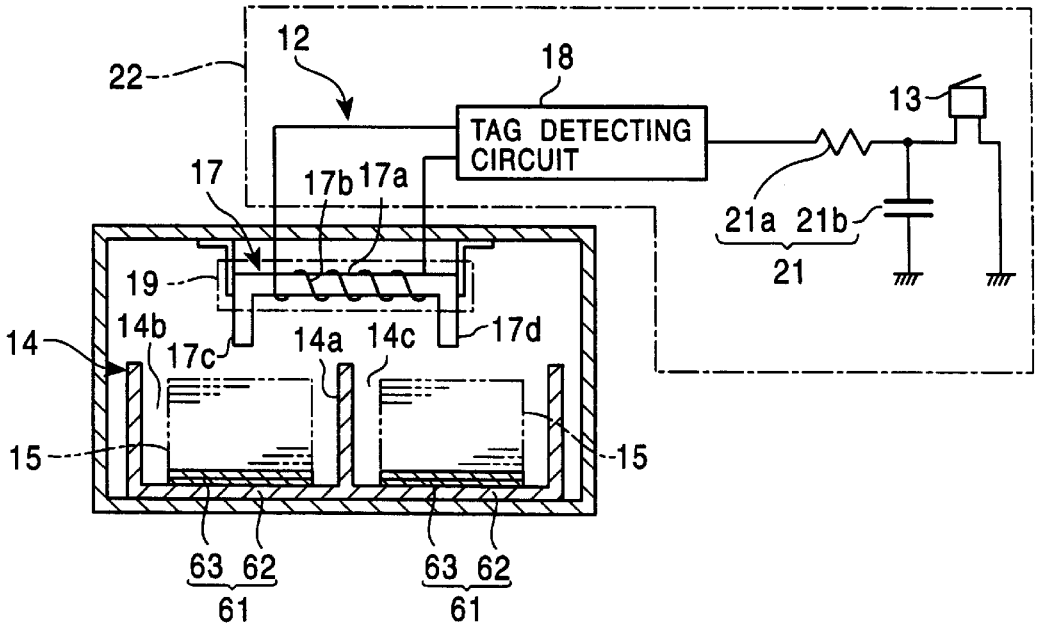
FIG. 12 is a block diagram showing the relationship between the tag detecting sensor and the alarm, corresponding to FIG. 2.
Figure 13:
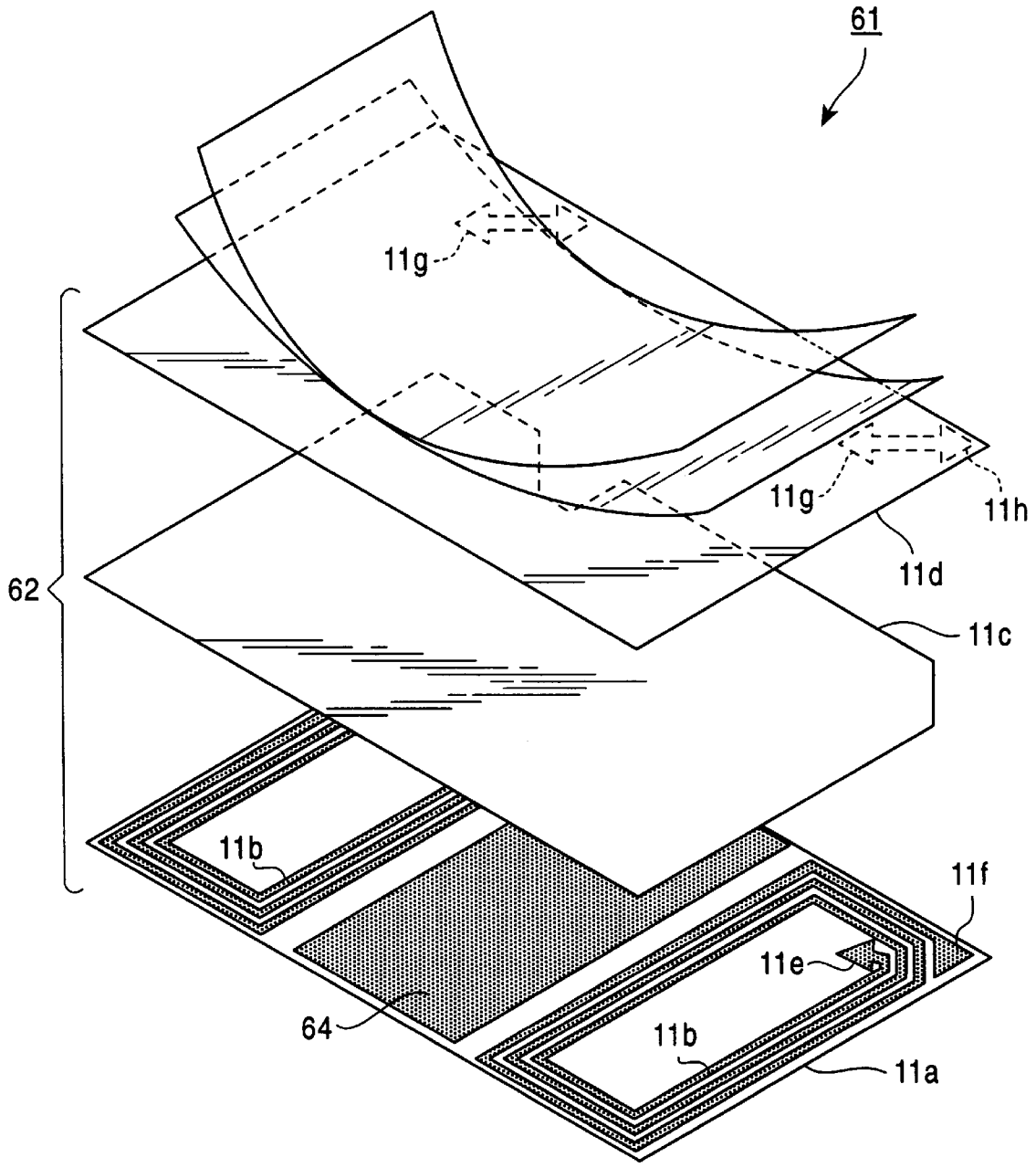
FIG. 13 is an exploded perspective view of the theft detecting tag, corresponding to FIG. 6.

FIGS. 11 to 13 show a second embodiment of the present invention. The same numerals in the figures of the second embodiment as those in the first embodiment denote the same parts in the first embodiment. Thus, the descriptions of these same parts are omitted.

A theft detecting tag 61 employed in the second embodiment has the main part 62 of a tag and an attached sheet 63. As shown in FIGS. 11 and 12, the main part 62 of the tag is disposed in the drawer 14, which is a case kept in the safe 16 equipped with the tag detecting sensor 12. The metal retainers 26, or the auxiliary members, for retaining the contained bills from the top are respectively disposed in the pair of bill-containers 14*b* and 14*c* respectively arranged at left and right, which form the drawer 14 (FIG. 11). The main part 62 of the tag is one size larger than the bill 15, and is made a little smaller than the bottom area of the pair of bill-containers 14*b* and 14*c*. The main part 62 of the tag, as shown in FIG. 13, has the insulating base sheet 11*a*, a coil 11*b* formed on the upper surface of the insulating base sheet 11*a*, a dielectric layer 11*c* adhered to the insulating base sheet 11*a* in a manner that the layer 11*c* covers the upper surface of the base sheet 11*a* through the coil 11*b*, and a surface layer 11*d* formed of an insulating material and adhered to the dielectric layer 11*c* in a manner that the layer 11*d* covers the upper surface of the layer 11*c*.

On the insulating base sheet 11*a* of the embodiment, the two coils 11*b* having the substantially same shape and size are formed at both edges of the base sheet at specified intervals in such a manner that they are disposed apart from the center parts retained by the top ends of the metal retainers 26. At the center part of the sheet retained by the top end of the metal member 26 is disposed a metal sheet 64 of the same thickness as a conductive metal foil forming the coil 11*b*. More specifically, along with the coil 11*b*, the first electrode layer lie, and the first connecting terminal 11*f*, the metal sheet 64 is formed by etching the conductive metal foil (not shown) formed in close contact with the upper surface of the insulating base sheet 11*a* with a specified pattern. The dielectric layer 11*c* is adhered to the insulating base sheet 11*a* in such a manner that the layer 11*c* covers the upper surface of the base sheet through the coil 11*b* and the metal sheet 64, while the surface layer lid is adhered to the dielectric layer 11*c* in such a manner that the layer 11*d* covers the upper surface of the layer 11*c* adhered as above. This arrangement permits the first and second connecting terminals 11*f* and 11*h* to be electrically connected to each other, and permits the first electrode layer 11*e*, the dielectric layer 11*c*, and the second electrode layer 11*g* to form a capacitor 11*i*. The capacitor 11*i* and the coil 11*b* form a resonant circuit section 23.

Two attached sheets 63 are disposed on one side of the main part 62 of the tag. The sheets 63 have the same shape, size, and texture as those of the bills 15, notes, or securities, which are supposed to be kept in the safe 16. In this embodiment, the attached sheet 63 is made by cutting paper having the same thickness and texture as those of the bill 15 into the same size as that of the bill 15. The two attached sheets 63 made by the method above are stacked together to be disposed on the upper surface of the main part 62 of the tag in such a manner that the center part of the sheet 63 indicated by oblique lines in FIG. 13 is adhered to the substantially center part of the main part 62 of the tag.

As shown in FIGS. 11 and 12, the main part 62 of the tag, on which the two attached sheets 63 are stacked together, is placed in the pair of bill-containers arranged at left and right sides inside the drawer 14. In this state, the attached sheets 63 are placed on the tag 62. The bills 15 are stacked on the attached sheets 63 disposed on the tags 62 respectively arranged in the bill-containers 14*b* and 14*c*, while the metal retainers are respectively arranged for retaining the stacked bills 15 from the top. When the bills 15 are retained by the metal retainer 26, one of the resonant circuit sections 23 is disposed apart from the metal retainer 26, as an auxiliary member, and the metal sheet 64 is disposed at the position retained by the metal retainer 26.

In the theft detecting tag 61 having such an arrangement, when both of the tags 62 are taken out with the bills 15 from the drawer 14, the tag detecting sensor 12 detects the absence of the tags 62 in the drawer 14 so as to activate the buzzer 13. Since the attached sheets 63 having the same shape, size, and texture as those of the bills 15 are stacked on the tags 62, when the robber holds the bills 15 placed on the attached sheets 63, he feels that the attached sheets 63 are parts of the bills 15. Thus, the robber takes out both the bills 15 and the attached sheets 63 with no precaution. Since the attached sheets 63 are partially adhered to the tags 62, the tags 62 are also taken out with the attached sheets 63. This allows the tag detecting sensor 12 to detect the absence of the tags 62 in the drawer 14 so as to activate the buzzer 13. As a result, an alarm given by the buzzer 13 permits the owner of the safe 16 to immediately notice the fact that the bills 15 kept in the safe 16 have been taken out without permission, so that he can quickly report the incident to the police.

When the tags 62 are disposed in the drawer 14, of the resonant circuit sections 23, the resonant circuit section 23 that is disposed apart from the metal retainer 26 produces resonance, so that the tag detecting circuit 18 does not activate the buzzer 13. At the position retained by the metal retainer 26 on the insulating base sheet 11*a* is disposed the metal sheet 64 having the same thickness as that of the conductive metal foil forming the resonant circuit section 23. Since this permits the thickness of the main part 62 of the tag to be made uniform, the bills 15 kept by stacking on the attached sheet 63 are contained in such a manner that their configurations are naturally uniform. Moreover, the arrangement of the metal sheet 64 permits the strength of the main part 62 of the tag, which is necessary for repetitive use, to be increased, and it also permits the thickness of the main part 62 of the tag to be uniform, so that even if the tag 61 is stacked when the tag 61 is not used for detection, an inclination due to non-uniform thickness does not occur so as to make the storing of the tag relatively easy.

In the second embodiment above, the metal sheet 64 is disposed at the center part retained by the metal retainer 26 on the insulating base sheet 11*a*. Alternatively, without disposing the metal sheet 64, it is possible to make a tag having no resonant circuit section at the position retained by the metal retainer 26 as an auxiliary member. In the case of such a theft detecting tag, since neither the metal sheet 64 or the resonant circuit section 23 is present at the position retained by the auxiliary member 26, it is possible for the theft detecting tag to be folded at the part in which no resonant circuit section 23 is present. Moreover, even if the main part 62 of the tag is repeatedly retained by the auxiliary member 26, the resonant circuit section 23 is not damaged. Therefore, in the case of a theft detecting tag in which a resonant circuit section is arranged at the position retained by the auxiliary member 26, when the tag damaged by being folded or repeatedly retained by the auxiliary member 26 is disposed in the reversed direction, the alarm 13 can be mistakenly activated. However, the theft detecting tag of the present invention does not allow such a mistaken operation to occur.

Furthermore, although the second embodiment above uses bills for the description, alternatively, securities or notes can be contained in the safe 16.

In addition, in the second embodiment, the two attached sheets 63 are stacked together on one side of the main part 62 of the tag. However, the number of attached sheets should not be restricted to this case, and also the sheets can be stacked on both sides of the main part 62 of the tag.

Although the safe 16 is used for the description in the first and second embodiments above, a glass showcase for displaying jewelry and noble-metal goods, a cash register or the like which is a terminal device of the POS (point of sales) system is applicable.

In the first and second embodiments, although a buzzer is used for an alarm, other types of devices such as a lamp can be used. The alarm may be installed in a station for security guards or a security firm. In this case, the theft of the bills can be immediately informed to a security guard, so that a quick response against the incident can be made.

As described above, according to the present invention, when a tag having one or more resonant circuit sections is located with an article in a specified place, an alarm is not activated. In contrast, when the tag is taken out with the article and a tag detecting sensor detects the absence of the tag in the specified place, the alarm is activated to inform of the incident. Accordingly, arranging the tag with bills, notes, or securities which is supposed to be kept in a cash register, a safe, or the like, permits the theft of them to be detected.

When a conductive or magnetic auxiliary member is arranged between the tag detecting sensor and the tag, by disposing one of the resonant circuit sections at a position apart from the auxiliary member, the resonant circuit section permits the tag detecting sensor to detect whether the tag is present or not. Thus, even if a conductive or magnetic auxiliary member is arranged between the tag detecting sensor and the tag, the detecting capability of the sensor is not affected by the arrangement and the sensor can detect effectively whether the tag is present in the specified place or not.

In the arrangement, the specified place is a case in a cash register or a safe, the article is a number of bills, notes, or securities, and the auxiliary member is a metal retainer for retaining the article. In this state, the theft detecting tag can detect the taken-out articles, such as bills, notes, or securities, which are kept in the cash register or the safe having the auxiliary member. The insulating base sheet which is formed into the substantially same shape and size as those of the article so as to be kept with the article in the safe, etc., permits the theft of the article to be detected effectively.

In addition, the formation of fold lines corresponding to the fold lines or perforations of the article on the insulating base sheet and the arrangement of a resonant circuit section at a position apart from these lines on the base sheet prevent the resonant circuit section from damage due to being folded with the base sheet.

The main part of the tag in accordance with the present invention has the resonant circuit section, and is disposed in the case of the register or the safe so as to activate the alarm. A partial adherence of attached sheets having the same shape, size, and texture as those of the article to one side or both sides of the main part of the tag by stacking them together gives the robber a feeling that the attached sheet is also a bill, when he seizes the article stacked on the attached sheet. Thus, the robber takes out the sheet with the article without precaution. Furthermore, since the attached sheet is partially adhered to the main part of the tag, the main part of the tag is taken out with the attached sheet. As a result, this permits the alarm to be activated, resulting in effective detection of the theft of the article.

The absence of a resonant circuit section disposed at the position retained by the auxiliary member permits the tag to be folded at the position, and also permits the resonant circuit section not to be damaged even if the tag is retained repeatedly by the auxiliary member. Therefore, the following can be pointed out: in a theft detecting tag in which a resonant circuit section is arranged at the position retained by the auxiliary member 26, when the tag damaged by being folded or repeatedly retained by the auxiliary member 26 is disposed in the reversed direction, the alarm 13 can be mistakenly activated. However, the theft detecting tag of the present invention does not allow such a mistaken operation to occur. On the other hand, at the position retained by the metal retainer on the insulating base sheet is disposed the metal sheet having the same thickness as that of the conductive metal foil forming the resonant circuit section. Since this permits the thickness of the tag to be made uniform, the bills kept by stacking on the attached sheet 63 are contained in such a manner that their configurations are naturally uniform.

What is claimed is:

1. A theft detecting tag comprising:

an insulating base sheet; and one or more resonant circuit sections disposed on said insulating base sheet and configured to be detected by a signal transmitted from an antenna;

wherein when the tag is located with an article in a specified place so as to be detected by a tag detecting sensor near the article, an alarm is not activated, while when the tag is not detected by the sensor, the alarm is activated.

2. A theft detecting tag according to claim 1, wherein when a conductive or magnetic auxiliary member is disposed between the tag detecting sensor and the tag, at least one of the resonant circuit sections is disposed apart from the auxiliary member.

3. A theft detecting tag according to claim 1 or 2, wherein the specified place is a case in a cash register or a safe, the article is a number of bills, notes, or securities, the auxiliary member is a metal member retaining the article, and the insulating base sheet is formed into substantially the same shape and size as those of the article.

4. A theft detecting tag according to claim 3, wherein the resonant circuit section is disposed apart from a fold line of the base sheet when a fold line corresponding to a fold line or perforation formed on the article is formed on the insulating base sheet.

5. A theft detecting tag comprising:

a main part of a tag having an insulating base sheet and one or more resonant circuit sections disposed on said insulating base sheet and configured to be detected by a signal transmitted from an antenna;

wherein the tag is disposed in a case in a cash register or a safe equipped with a tag detecting sensor for keeping bills, notes, or securities;

wherein an alarm is not activated when the tag is detected by the sensor, while the alarm is activated when the tag is not detected by the sensor; and an attached sheet having the same shape, size, and texture as those of the article;

wherein one or more pieces of the sheet are stacked on one side or both sides of the main part of the tag to be partially adhered to the same.

6. A theft detecting tag according to claim 5, wherein one of the resonant circuit sections is disposed apart from a conductive or magnetic auxiliary member when the auxiliary member is arranged between the tag detecting sensor and the main part of the tag, and no resonant circuit section is present at the position retained by the auxiliary member.

7. A theft detecting tag according to claim 5, wherein one of the resonant circuit sections is disposed apart from a conductive or magnetic auxiliary member when the auxiliary member is arranged between the tag detecting sensor and the main part of the tag, and a metal sheet having the same thickness as that of a conductive metal foil forming the resonant circuit section is disposed at the position retained by the auxiliary member on the insulating base sheet.

8. A theft detecting tag comprising:

base means; and one or more resonant means disposed on said base means and for being detected by a signal transmitted from an antenna;

wherein when the tag is located with an article in a specified place so as to be detected by a tag detecting means near the article, an alarm is not activated, while when the tag is not detected by the detecting means, the alarm is activated.

9. A theft detecting tag according to claim 8, wherein when a conductive or magnetic auxiliary member is disposed between the tag detecting means and the tag, at least one of the resonant means is disposed apart from the auxiliary member.

10. A theft detecting tag according to claim 8 or 9, wherein the specified place is a case in a cash register or a safe, the article is a number of bills, notes, or securities, the auxiliary member is a metal member retaining the article, and the base means is formed into substantially the same shape and size as those of the article.

11. A theft detecting tag according to claim 10, wherein the resonant means is disposed apart from a fold line of the base means when a fold line corresponding to a fold line or perforation formed on the article is formed on the base means.

12. A theft detecting tag comprising:

a main part of a tag having a base means and one or more resonant means disposed on said base means and for being detected by a signal transmitted from an antenna;

wherein the tag is disposed in a case in a security location for keeping an object equipped with a tag detecting means;

wherein an alarm is not activated when the tag is detected by the detecting means, while the alarm is activated when the tag is not detected by the detecting means; and an attached sheet having at least one of the same shape, size, and texture as of the article;

wherein one or more pieces of the attached sheet are stacked on one side or both sides of the main part of the tag to be partially adhered to the main part of the tag.

13. A theft detecting tag according to claim 12, wherein one of the resonant means is disposed apart from a conductive or magnetic auxiliary member when the auxiliary member is arranged between the tag detecting means and the main part of the tag, and no resonant means is present at the position retained by the auxiliary member.

14. A theft detecting tag according to claim 12, wherein one of the resonant means is disposed apart from a conductive or magnetic auxiliary member when the auxiliary member is arranged between the tag detecting means and the main part of the tag, and a metal sheet having the same thickness as that of a conductive metal foil forming the resonant means is disposed at the position retained by the auxiliary member on the base means.

* * * * *

UNITED STATES PATENT AND TRADEMARK OFFICE

CERTIFICATE OF CORRECTION

PATENT NO. : 6,255,947 B1
DATED : July 3, 2001
INVENTOR(S) : Osawa et al.

It is certified that error appears in the above-identified patent and that said Letters Patent is hereby corrected as shown below:

Title page, Item [54], and Column 1, line 1,
The title should be:

-- [54] THEFT DETECTING TAG --

Signed and Sealed this

Nineteenth Day of February, 2002

*Attest:*

*Attesting Officer*

JAMES E. ROGAN
*Director of the United States Patent and Trademark Office*